US009358791B2

(12) United States Patent
Schneider et al.

(10) Patent No.: US 9,358,791 B2
(45) Date of Patent: Jun. 7, 2016

(54) PRINTHEAD NOZZLE MAINTENANCE

(71) Applicant: Hewlett-Packard Industrial Printing Ltd., Fort Collins, CO (US)

(72) Inventors: Matan Schneider, Nes Ziona (IL); Moti Balaish, Netanya (IL); Alon Navon, Azour (IL); Harel Malka, Netanya (IL)

(73) Assignee: Hewlett-Packard Industrial Printing LTD, Netanya (IL)

( * ) Notice: Subject to any disclaimer, the term of this patent is extended or adjusted under 35 U.S.C. 154(b) by 0 days.

(21) Appl. No.: 14/621,169

(22) Filed: Feb. 12, 2015

(65) Prior Publication Data

US 2015/0246542 A1 Sep. 3, 2015

(30) Foreign Application Priority Data

Feb. 28, 2014 (EP) ..... 14275034

(51) Int. Cl.
*B41J 2/165* (2006.01)

(52) U.S. Cl.
CPC ..... *B41J 2/16517* (2013.01); *B41J 2/16535* (2013.01); *B41J 2/16552* (2013.01); *B41J 2/16585* (2013.01); *B41J 2002/16555* (2013.01)

(58) Field of Classification Search
CPC ..... B41J 2002/16555; B41J 2/16552
See application file for complete search history.

(56) References Cited

U.S. PATENT DOCUMENTS

| | | | | |
|---|---|---|---|---|
| 4,970,535 | A * | 11/1990 | Oswald et al. | 347/25 |
| 6,273,103 | B1 | 8/2001 | Enz et al. | |
| 6,550,889 | B2 | 4/2003 | Colombat et al. | |
| 6,682,165 | B2 | 1/2004 | Yearout | |
| 7,004,559 | B2 | 2/2006 | Aliaga | |
| 7,055,931 | B2 | 6/2006 | West et al. | |
| 2005/0044653 | A1 * | 3/2005 | Wakao et al. | 15/302 |
| 2007/0252863 | A1 | 11/2007 | Sun et al. | |
| 2010/0245461 | A1 | 9/2010 | Niimi et al. | |
| 2011/0074869 | A1 * | 3/2011 | Kanata et al. | 347/25 |
| 2011/0074870 | A1 * | 3/2011 | Maida | B08B 3/02 347/28 |
| 2011/0227998 | A1 * | 9/2011 | Kamiyama | B41J 2/16552 347/29 |
| 2012/0186606 | A1 | 7/2012 | Barss et al. | |
| 2012/0212542 | A1 | 8/2012 | Kimura | |
| 2013/0076830 | A1 * | 3/2013 | Inoue | 347/33 |
| 2013/0162712 | A1 * | 6/2013 | Yamanobe | 347/16 |

FOREIGN PATENT DOCUMENTS

| | | | |
|---|---|---|---|
| CN | 102602152 | | 7/2012 |
| EP | 2233295 | A1 | 9/2010 |
| KR | 20100031284 | A | 3/2010 |
| TW | 200918334 | | 5/2009 |
| WO | WO-2008105280 | A1 | 9/2008 |

* cited by examiner

*Primary Examiner* — Stephen Meier
*Assistant Examiner* — John P Zimmermann
(74) *Attorney, Agent, or Firm* — HP Inc Patent Department

(57) ABSTRACT

A printhead maintenance device includes a maintenance housing including a set of maintenance nozzles, an air controlling member, and a waste collector. The maintenance housing moves to selectively position the set of maintenance nozzles opposite a printhead including a nozzle surface having a plurality of nozzles to eject fluid. The set of maintenance nozzles provide fluid onto the nozzle surface of the printhead to remove residue therefrom. The air controlling member forms air flow paths to at least one of direct the fluid provided by the maintenance nozzles at an angle to the nozzle surface and direct the residue maintenance nozzles to the waste collector.

19 Claims, 6 Drawing Sheets

PRINTHEAD NOZZLE MAINTENANCE

BACKGROUND

Printing systems may include printheads such as inkjet printheads including a nozzle surface having nozzles to eject printing fluid in the form of drops therefrom. Printing systems may include printhead maintenance devices such as wipers and/or blades to clean the printheads. The wiper and/or blade may contact a nozzle surface of the printhead to remove residue from the nozzle surface thereof.

BRIEF DESCRIPTION OF THE DRAWINGS

Non-limiting examples are described in the following description, read with reference to the figures attached hereto and do not limit the scope of the claims. Dimensions of components and features illustrated in the figures are chosen primarily for convenience and clarity of presentation and are not necessarily to scale. Referring to the attached figures:

DETAILED DESCRIPTION

Printing systems may include printheads such as inkjet printheads including a nozzle surface having nozzles to eject printing fluid in the form of drops therefrom. The printhead maintenance devices may include wipers and/or blades to clean the printheads. That is, periodically, residue may accumulate at a nozzle surface and nozzles of the printhead. At times, nozzles may malfunction, for example, due to obstructions and/or a de-primed condition thereof. The wiper and/or blade may contact a nozzle surface of the printhead to remove residue from the nozzle surface. However, the wiper and/or blade may not be able to correct the de-primed condition of the respective malfunctioning nozzles. Further, the wiper and/or blade may increase the cost of the printhead maintenance device and delay the printing of images on media. Thus, image degradation and a decrease in throughput of the printing systems may result.

In examples, a printhead maintenance device includes a maintenance housing including a set of maintenance nozzles, an air controlling member, and a waste collector. The maintenance housing moves to selectively position the set of maintenance nozzles opposite a printhead including a nozzle surface having a plurality of nozzles to eject fluid. The set of maintenance nozzles provide fluid onto the nozzle surface of the printhead to remove residue therefrom. The air controlling member forms air flow paths to at least one of direct the fluid provided by the maintenance nozzles at an angle onto the nozzle surface and direct the residue from the nozzle surface to the waste collector. Accordingly, activation of the nozzle recovery routine may correct the malfunctioning nozzles by priming them without increasing the cost of the printhead recovery system and delaying printing of images on media. Thus, image degradation and a decrease in throughput of the printing system may be reduced.

Figure 1:
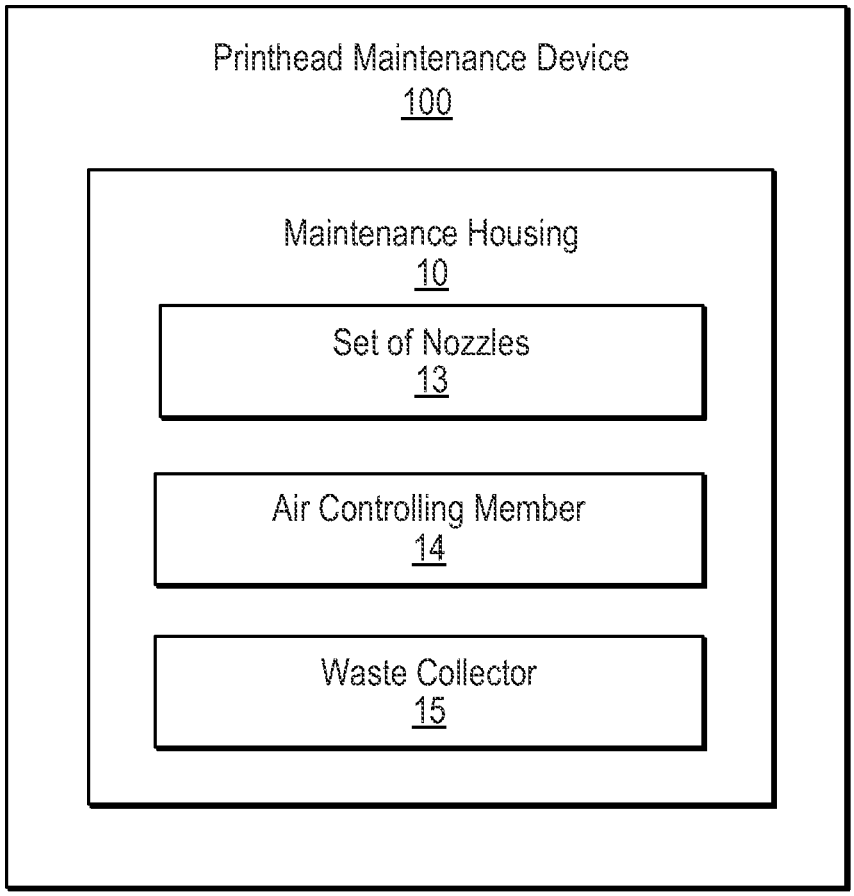
FIG. 1 is a block diagram illustrating a printhead maintenance device according to an example.

FIG. 1 is a block diagram illustrating a printhead maintenance device according to an example. Referring to FIG. 1, in some examples, a printhead maintenance device 100 includes a maintenance housing 10. The maintenance housing 10 includes a set of maintenance nozzles 13, an air controlling member 14, and a waste collector 15. The maintenance housing 10 moves to selectively position the set of maintenance nozzles 13 opposite a respective printhead including a nozzle surface having a plurality of nozzles to eject fluid such as printing fluid. For example, a motor, servomechanism, and/or an air piston (not illustrated) may selectively move the maintenance housing 10 along a beam member 27 (FIGS. 2-3) supporting a plurality of printheads.

Referring to FIG. 1, in some examples, the set of maintenance nozzles 13 provide fluid onto the nozzle surface of a respective printhead to remove residue therefrom. The air controlling member 14 forms air flow paths to at least one of direct the fluid at an angle from the maintenance nozzles 13 onto the nozzle surface and direct the residue from the respective nozzle surface to the waste collector 15. The waste collector 15 may collect the residue removed from the respective nozzle surface. In some examples, used fluid may be collected by the maintenance housing 10, for example, the used fluid may also be directed to the waste collector 15 by a respective air flow path.

The air controlling member 14 may be implemented in hardware, software including firmware, or combinations thereof. The firmware, for example, may be stored in memory and executed by a suitable instruction-execution system. If implemented in hardware, as in an alternative example, the air controlling member 14 may be implemented with any or a combination of technologies which are well known in the art (for example, discrete-logic circuits, application-specific integrated circuits (ASICs), programmable-gate arrays (PGAs), field-programmable gate arrays (FPGAs)), and/or other later developed technologies. In other examples, the air controlling device 14 may be implemented in a combination of software and data executed and stored under the control of a computing device.

Figure 2:
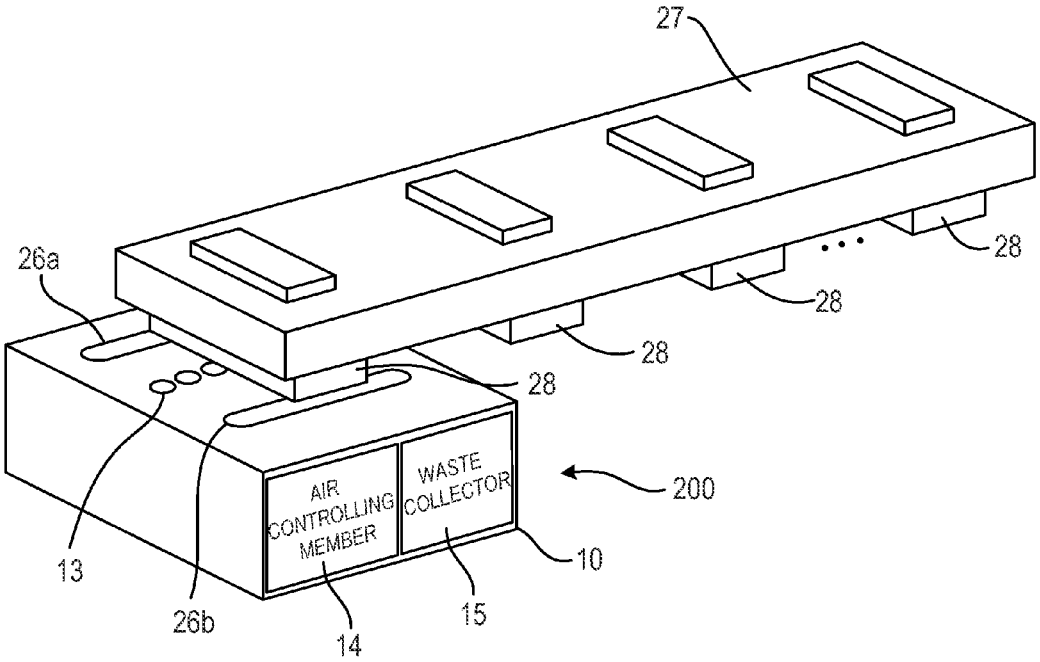
FIG. 2 is a schematic view illustrating a printhead maintenance device usable with printheads according to an example.
Figure 3:
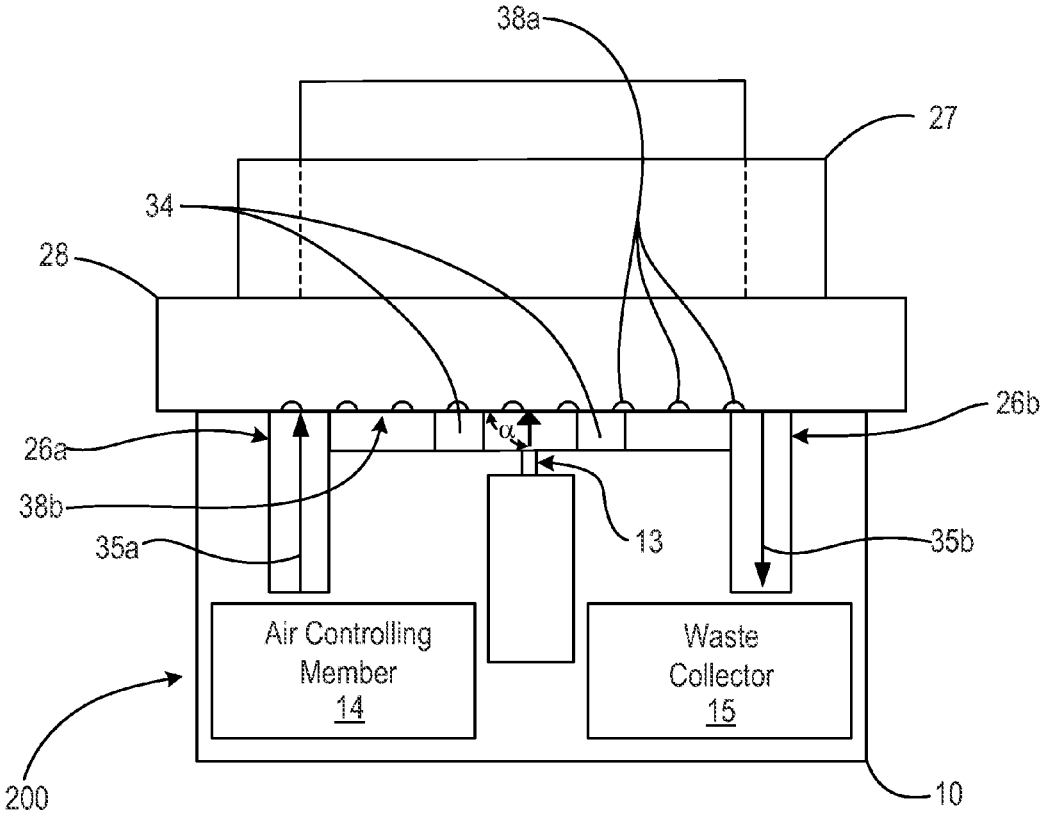
FIG. 3 is a cross-sectional view illustrating a portion of the printhead maintenance device and a respective printhead according to an example.

FIG. 2 is a schematic view illustrating a printhead maintenance device usable with printheads according to an example. FIG. 3 is a cross-sectional view illustrating the printhead maintenance device of FIG. 2 and a respective printhead according to an example. A printhead maintenance device 200 may include the maintenance housing 10 as previously discussed with respect to the printhead maintenance device 100 of FIG. 1. A plurality of printheads 28 may be supported on a beam member 27. Referring to FIGS. 2 and 3, in some examples, the maintenance housing 10 includes a set of maintenance nozzles 13, an air controlling member 14, a waste collector 15, and gutters 34. In some examples, the set of maintenance nozzles 13 ejects the fluid and the air controlling member 14 forms the air flow paths 35*a* and 35*b* in a simultaneous manner.

Figure 4:
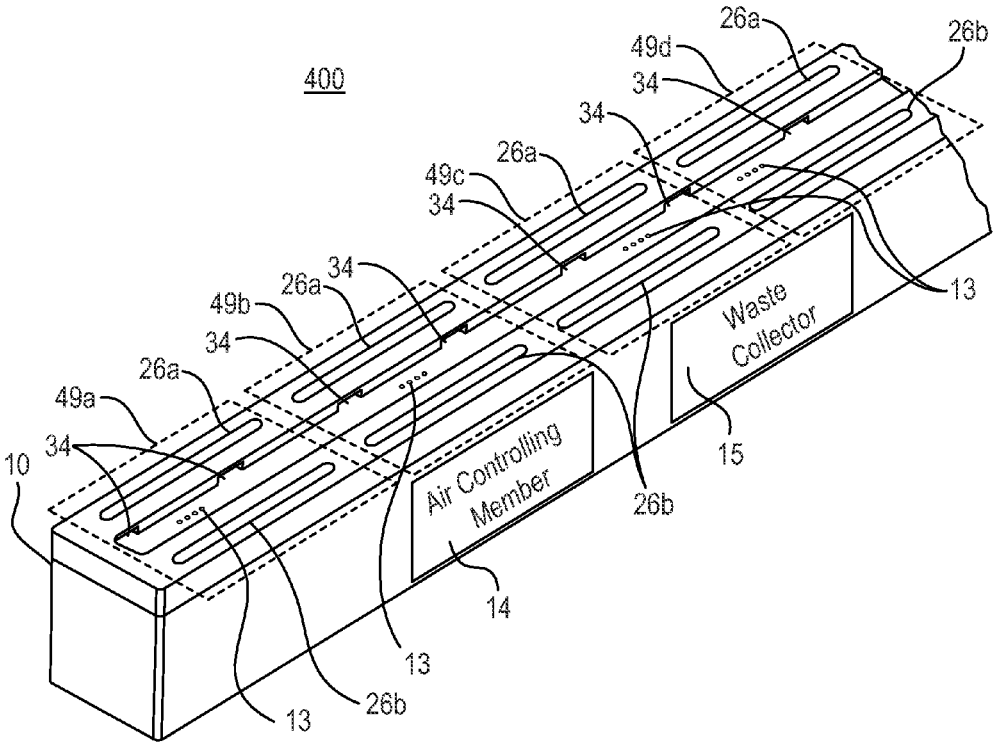
FIG. 4 is a schematic view illustrating a printhead maintenance device according to an example.

That is, fluid ejected from the maintenance nozzles 13 are directed to a nozzle surface 38*b* of a respective printhead 28 by a respective air flow path 35*a* as residue is removed from the nozzle surface 38*b* and directed to a waste collector 15 by a respective air flow path 35*b*. In some examples, each one of the maintenance nozzles 13 is configured to eject fluid to simultaneously encompass a plurality of nozzles 38*a* as illustrated in FIG. 4. That is, a perimeter of the fluid ejected from the maintenance nozzles 13 may be greater than a perimeter of each respective nozzle 38*a* on the printhead 28.

Figure 5:
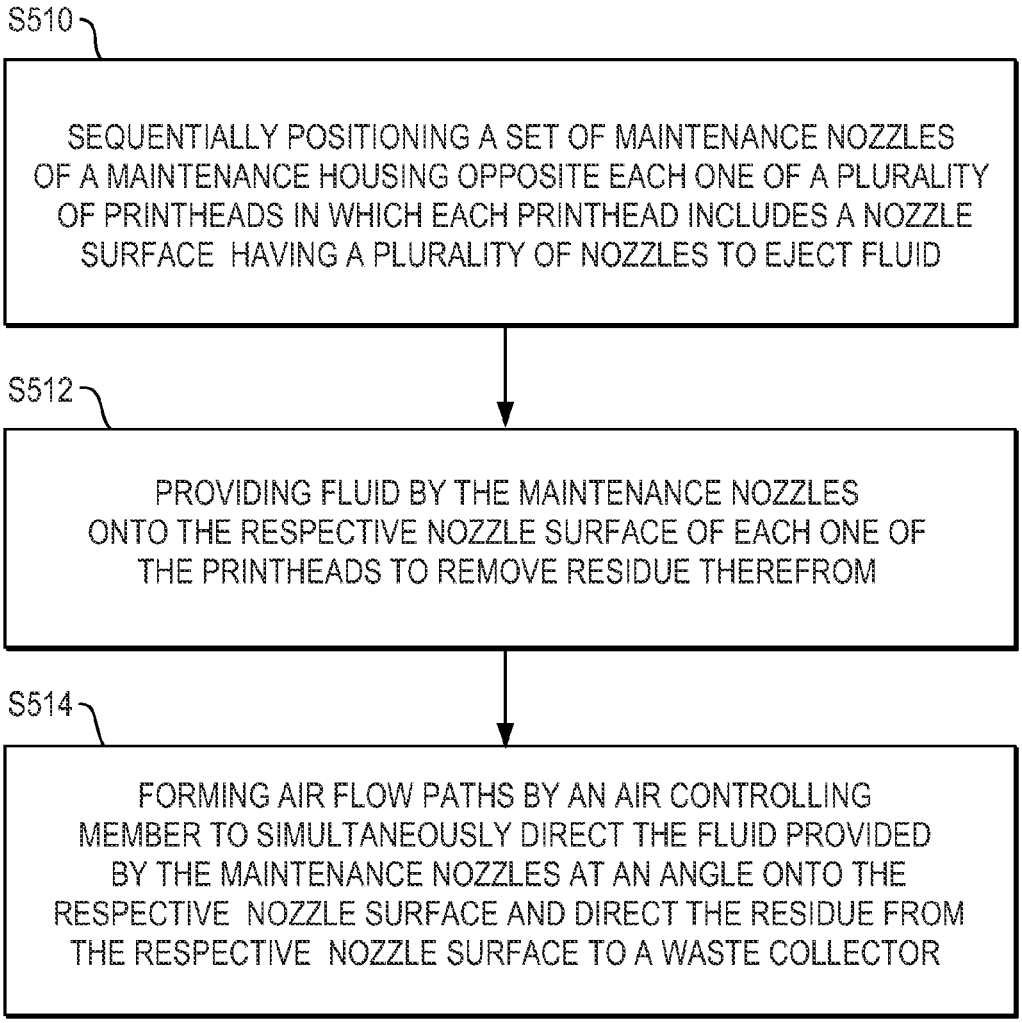
FIG. 5 is a flowchart illustrating a method of maintaining printheads according to an example.

Referring to FIGS. 2 and 3, in some examples, the air controlling member 14 may form a first air flow path 35*a* to direct the fluid such as solvent provided by the maintenance nozzles 13 at an angle α onto the respective nozzle surface 38*b*. In some examples, the air controlling member 14 may change an amount of air pressure of a respective air flow path to change the angle α in which the fluid is directed onto the respective nozzle surface 38*b* as illustrated in FIG. 5. Additionally, the air controlling member 14 may form a second air flow path 35*b* to direct the residue from the respective nozzle surface 38*b* to the waste collector 15. In some examples, the waste collector 15 may include a spittoon.

Referring to FIG. 3, in some examples, the maintenance housing 10 further comprises a plurality of slots such as a first slot 26*a* and a second slot 26*b*. In some examples, the maintenance nozzles 13 are disposed between the first slot 26*a* and the second slot 26*b*. The first air flow path 35*a* may pass through the first slot 26*a* to direct the fluid provided by the set of maintenance nozzles 13 onto a respective nozzle surface 38*b*. The second air flow path 35*b* may pass through the second slot 26*b* to receive the residue. In some examples, the first air flow path 35*a* is formed by a positive pressure and the second air flow path 35*b* is formed by a negative pressure. In some examples, the air controlling member 14 may include an air movement device such as an air knife, and the like. The maintenance housing 10 may also include gutters 34 to receive used fluid, and the like, from the respective nozzle surfaces 38*a*.

FIG. 4 is a schematic view illustrating a printhead maintenance device according to an example. Referring to FIG. 4, in some examples, the printhead maintenance device 400 may include the maintenance housing 10 may include a plurality of maintenance groups 49*a*, 49*b*, 49*c*, and 49*d* such that each maintenance group may be positioned to correspond to a respective printhead. Each maintenance group, for example, may include a corresponding set of maintenance nozzles 13, a corresponding first slot 26*a*, and a second slot 26*b*. The printhead maintenance device may also include an air controlling member 14, a waste collector 15, and gutters 34 as previously discussed with respect to the printhead maintenance device 200 of FIGS. 2-3. The maintenance housing 10 moves to selectively position the set of maintenance nozzles 13 opposite a respective printhead including a nozzle surface having a plurality of nozzles to eject fluid such as printing fluid. For example, a motor and/or servomechanism (not illustrated) may selectively move the maintenance housing 10 along a beam member supporting a plurality of printheads.

FIG. 5 is a flowchart illustrating a method of maintaining printheads according to an example. In some examples, the modules, assemblies, and the like, previously discussed with respect to FIGS. 1-4 may be used to implement the method of maintaining printheads of FIG. 5. Referring to FIG. 5, in block S510, selectively positioning a set of maintenance nozzles of a maintenance housing opposite each one of a plurality of printheads in which each printhead includes a nozzle surface having a plurality of nozzles to eject fluid. In some examples, a motor and/or servomechanism (not illustrated) may selectively move the maintenance housing along a beam member supporting the printheads. In block S512, providing fluid by the maintenance nozzles onto the respective nozzle surface of each one of the printheads to remove residue therefrom.

In block S514, forming air flow paths by an air controlling member to simultaneously direct the fluid at an angle from the maintenance nozzles onto the respective nozzle surface and direct the residue from the respective nozzle surface to a waste collector. For example, forming air flow paths may include forming a first air flow path to direct the fluid at an angle from the maintenance nozzles onto the respective nozzle surface and a second air flow path to direct the residue from the respective nozzle surface to the waste collector. The method may also include changing an amount of air pressure of a respective air flow path by the air controller member to change the angle in which the fluid is directed onto the respective nozzle surface. For example, an amount of change of the angle may be directly related to the amount of change of the air pressure.

Figure 6:
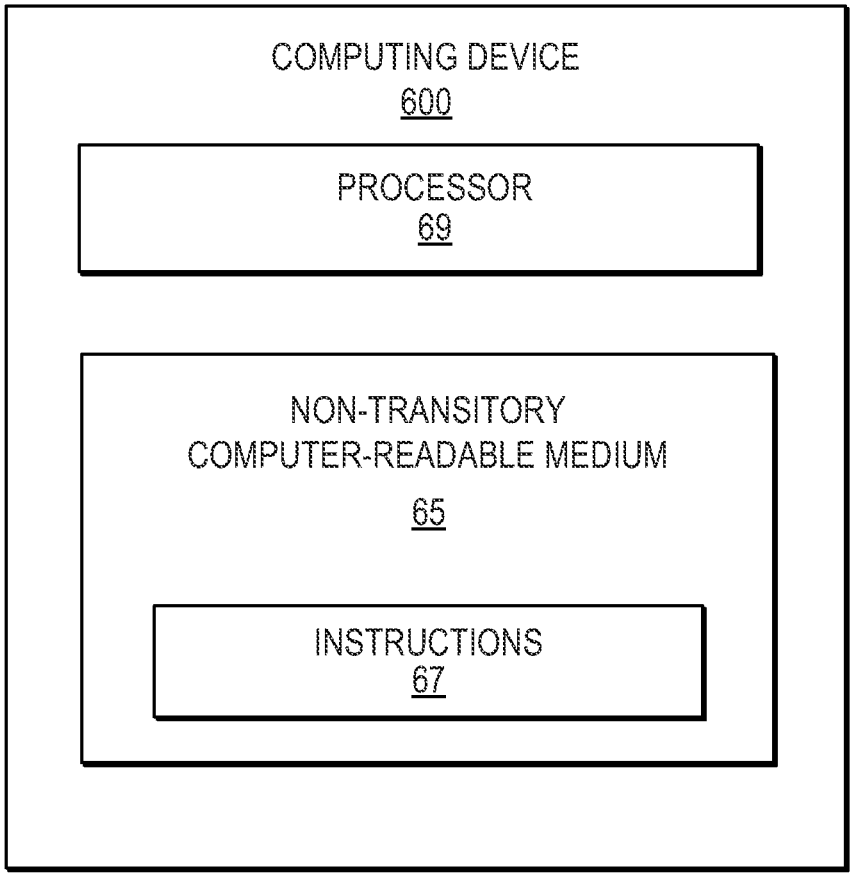
FIG. 6 is a block diagram illustrating a computing device such as a printhead maintenance device including a processor and a non-transitory, computer-readable storage medium to store instructions to operate the printhead maintenance device according to an example.

FIG. 6 is a block diagram illustrating a computing device such as a printhead maintenance device including a processor and a non-transitory, computer-readable storage medium to store instructions to operate the printhead maintenance device according to an example. Referring to FIG. 6, in some examples, the non-transitory, computer-readable storage medium 65 may be included in a computing device 600 such as a printhead maintenance device including a control module 12. In some examples, the non-transitory, computer-readable storage medium 65 may be implemented in whole or in part as instructions 67 such as computer-implemented instructions stored in the computing device locally or remotely, for example, in a server or a host computing device.

Referring to FIG. 6, in some examples, the non-transitory, computer-readable storage medium 65 may correspond to a storage device that stores instructions 67, such as computer-implemented instructions and/or programming code, and the like. For example, the non-transitory, computer-readable storage medium 65 may include a non-volatile memory, a volatile memory, and/or a storage device. Examples of non-volatile memory include, but are not limited to, electrically erasable programmable read only memory (EEPROM) and read only memory (ROM). Examples of volatile memory include, but are not limited to, static random access memory (SRAM), and dynamic random access memory (DRAM).

Referring to FIG. 6, examples of storage devices include, but are not limited to, hard disk drives, compact disc drives, digital versatile disc drives, optical drives, and flash memory devices. In some examples, the non-transitory, computer-readable storage medium 65 may even be paper or another suitable medium upon which the instructions 67 are printed, as the instructions 67 can be electronically captured, via, for instance, optical scanning of the paper or other medium, then compiled, interpreted or otherwise processed in a single manner, if necessary, and then stored therein. A processor 69 generally retrieves and executes the instructions 67 stored in the non-transitory, computer-readable storage medium 65, for example, to operate a computing device 600 such as a printhead maintenance device to store instructions to operate the printhead maintenance device in accordance with an example. In an example, the non-transitory, computer-readable storage medium 65 can be accessed by the processor 69.

It is to be understood that the flowchart of FIG. 5 illustrates architecture, functionality, and/or operation of examples of the present disclosure. If embodied in software, each block may represent a module, segment, or portion of code that includes one or more executable instructions to implement the specified logical function(s). If embodied in hardware, each block may represent a circuit or a number of interconnected circuits to implement the specified logical function(s). Although the flowchart of FIG. 5 illustrates a specific order of execution, the order of execution may differ from that which is depicted. For example, the order of execution of two or more blocks may be rearranged relative to the order illustrated. Also, two or more blocks illustrated in succession in FIG. 5 may be executed concurrently or with partial concurrence. All such variations are within the scope of the present disclosure.

The present disclosure has been described using non-limiting detailed descriptions of examples thereof that are not intended to limit the scope of the general inventive concept. It should be understood that features and/or operations described with respect to one example may be used with other examples and that not all examples have all of the features and/or operations illustrated in a particular figure or described with respect to one of the examples. Variations of examples described will occur to persons of the art. Furthermore, the terms "comprise," "include," "have" and their conjugates, shall mean, when used in the disclosure and/or claims, "including but not necessarily limited to."

It is noted that some of the above described examples may include structure, acts or details of structures and acts that may not be essential to the general inventive concept and which are described for illustrative purposes. Structure and acts described herein are replaceable by equivalents, which perform the same function, even if the structure or acts are different, as known in the art. Therefore, the scope of the general inventive concept is limited only by the elements and limitations as used in the claims.

What is claimed is:

1. A printhead maintenance device comprising:

a maintenance housing including a set of maintenance nozzles, an air controlling member, and a waste collector, the maintenance housing to move to selectively position the set of maintenance nozzles opposite a printhead including a nozzle surface having a plurality of nozzles to eject fluid;

the set of maintenance nozzles to provide fluid onto the nozzle surface of the printhead to remove residue therefrom;

the air controlling member to form air flow paths to deflect a direction of fluid as provided by the maintenance nozzles such that the fluid is directed at a new angle onto the nozzle surface and direct the residue from the nozzle surface to the waste collector; and the waste collector to collect the residue removed from the nozzle surface;

wherein the maintenance housing further comprises:

a first slot in which the first air flow path passes through to direct the fluid from the set of maintenance nozzles onto a respective nozzle surface; and a second slot in which the second air flow path passes through to receive the residue;

wherein the set of maintenance nozzles are linearly arranged parallel to and between longitudinal axes of the first and second slots.

2. The printhead maintenance device of claim 1, wherein the set of maintenance nozzles is configured to eject the fluid and the air controlling member is configured to form the air flow paths in a simultaneous manner.

3. The printhead maintenance device of claim 1, wherein the air controlling member is to form a first air flow path to direct the fluid provided by the maintenance nozzles at an angle onto the nozzle surface and a second air flow path to direct the residue from the nozzle surface to the waste collector.

4. The printhead maintenance device of claim 1, wherein the air controlling member is configured to change an amount of air pressure of a respective air flow path to change the angle in which the fluid is directed onto the nozzle surface.

5. The printhead maintenance device of claim 1, wherein the first air flow path is formed by a positive pressure and the second air flow path is formed by a negative pressure.

6. The printhead maintenance device of claim 1, wherein maintenance nozzles are disposed between the first slot and the second slot.

7. The printhead maintenance device of claim 1, wherein each one of the maintenance nozzles is configured to eject fluid to simultaneously encompass a plurality of nozzles.

8. The printhead maintenance device of claim 1, wherein the fluid comprises a solvent.

9. The printhead maintenance device of claim 1, wherein the air controlling member comprises an air knife.

10. The printhead maintenance device of claim 1, wherein the waste collector comprises a spittoon.

11. A method of maintaining printheads comprising:

sequentially positioning a set of maintenance nozzles of a maintenance housing opposite each one of a plurality of printheads in which each printhead includes a nozzle surface having a plurality of nozzles to eject fluid;

providing a stream of fluid by each of the maintenance nozzles onto the respective nozzle surface of each one of the printheads to remove residue therefrom; and forming air flow paths by an air controlling member, separate from the maintenance nozzles, to simultaneously redirect a fluid stream provided by at least one of the maintenance nozzles to a new angle and onto the respective nozzle surface and to direct the residue from the respective nozzle surface to a waste collector.

12. The method of claim 11, wherein the forming air flow paths further comprises:

forming a first air flow path to direct the fluid stream provided by at least one of the maintenance nozzles to a new angle and onto the respective nozzle surface and a second air flow path to direct the residue from the respective nozzle surface to the waste collector.

13. The method of claim 11, further comprising:

changing an amount of air pressure of a respective air flow path by the air controller member to change the angle in which the fluid is directed onto the respective nozzle surface.

14. The printhead maintenance device of claim 1, wherein the air flow path from the air controlling member pulls the direction of fluid ejected by the maintenance nozzles toward an outlet from the air controlling member.

15. The printhead maintenance device of claim 1, wherein the maintenance nozzles are disposed in a recess in the maintenance housing so as to be below an outlet for the air controlling member and inlet for the waste collector with respect to a top surface of the maintenance housing.

16. The printhead maintenance device of claim 15, further comprising gutters provided in a sidewall of the recess.

17. A printhead maintenance device comprising:

a maintenance housing including a set of maintenance nozzles, an air controlling member, and a waste collector, the maintenance housing to move to selectively position the set of maintenance nozzles opposite a printhead including a nozzle surface having a plurality of nozzles to eject fluid;

the set of maintenance nozzles to provide fluid onto the nozzle surface of the printhead to remove residue therefrom;

the air controlling member to form air flow paths to: at least one of direct the fluid provided by the maintenance nozzles onto the nozzle surface and direct the residue from the nozzle surface to the waste collector; and the waste collector to collect the residue removed from the nozzle surface;

wherein the maintenance nozzles are disposed in a recess in the maintenance housing so as to be below an outlet for the air controlling member and inlet for the waste collector with respect to a top surface of the maintenance housing.

18. The printhead maintenance device of claim 17, further comprising gutters provided in a sidewall of the recess.

19. The method of claim 11, further comprising redirecting the fluid ejected by the maintenance nozzles into a different direction with pressure from an air flow path produced by the air controlling member.

* * * * *